United States Patent [19]

Bastian

[11] 4,145,787

[45] Mar. 27, 1979

[54] HAND DUSTER

[76] Inventor: Veit J. B. Bastian, 4071 Oxford Ave., Montreal, Quebec, Canada

[21] Appl. No.: 830,664

[22] Filed: Sep. 6, 1977

[30] Foreign Application Priority Data

Jul. 29, 1977 [CA] Canada ..... 283780

[51] Int. Cl.[2] ..... A47L 13/252

[52] U.S. Cl. ..... 15/229 AW; 15/206; 300/21

[58] Field of Search ..... 15/147 R, 147 A, 147 B, 15/206, 229; 300/21; 428/4

[56] References Cited

U.S. PATENT DOCUMENTS

| | | | |
|---|---|---|---|
| 1,008,071 | 11/1911 | Rowell | 15/229 R |
| 1,671,988 | 6/1928 | Greene | 15/209 R |
| 1,997,684 | 4/1935 | Hertzberg | 15/147 B |
| 2,041,985 | 5/1936 | Wallace | 15/206 |
| 2,174,633 | 10/1939 | Keydel | 15/147 B |
| 2,825,084 | 3/1958 | Sanborn | 15/229 A X |
| 2,895,155 | 7/1959 | Peterson | 15/206 X |
| 2,974,339 | 3/1961 | Keydel | 15/229 R X |
| 2,975,452 | 3/1961 | Doull | 15/209 R |
| 3,728,756 | 4/1973 | Argeris | 115/229 A |
| 3,999,232 | 12/1976 | Page | 15/229 R |

*Primary Examiner*—Daniel Blum

*Attorney, Agent, or Firm*—Raymond Trudeau

[57] ABSTRACT

The structure of a hand duster having soft yarns retained on the end of a spirally wound metal wire is disclosed wherein the soft yarns are bunched together by means of a single loop at the end of the spirally wound metal wire. The yarns consist of crimped synthetic fibers in two state permanently secured at their intermediate region by the single loop of the twisted wire. The method comprises preparing a bunch of yarns and retaining same against the curved end of the bent wire shaped in a hairpin configuration, and retaining the curved end of the wire while the generally parallel extending legs are spirally wound around one another along a straight line resulting in a tightly gripping loop around the middle portion of the bundle of yarns. The yarns are then teased and trimmed thereby to produce a round fluffy head portion. The spirally wound stem is then cut to a predetermined length and then a handle component is permanently secured to the free end of the stem.

6 Claims, 6 Drawing Figures

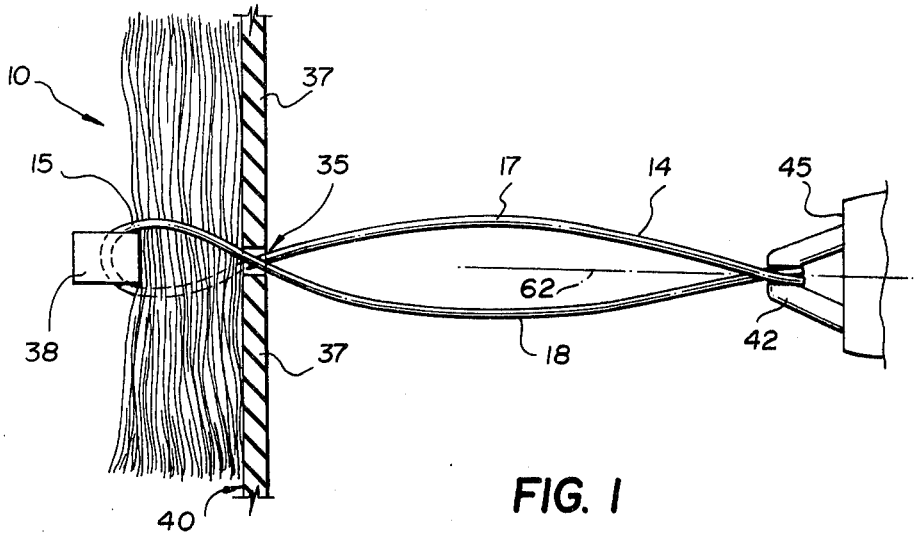
FIG. 1
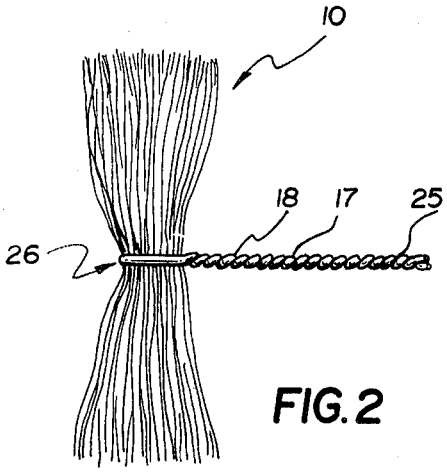
FIG. 2
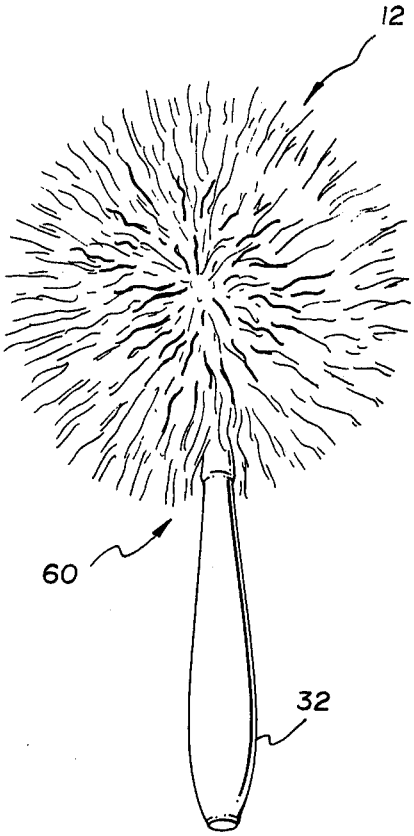
FIG. 3
FIG. 4a
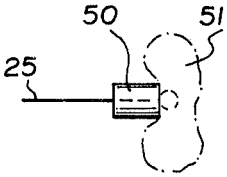
FIG. 4b
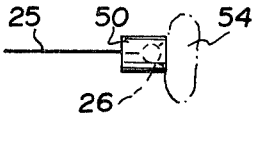
FIG. 4c
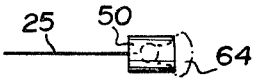

HAND DUSTER

This invention relates to hand dusters such as used for dusting small decorative articles, furniture, etc.

Hand dusters using long soft feathers are known to be increasingly expensive to produce and as a result various attempts have been made in the past to produce hand dusters using substitutes for the traditional feathers. However, most if not all such prior attempts have failed to yield an economical long lasting hand duster of comparable usefulness, and none appears to have gained commercial acceptance to any significant degree. Examples of prior hand duster designs will be found in Canadian Pat. No. 87,530 granted in 1904 for an invention by E. S. Winn entitled "Dusting Brushes", and in Canadian Pat. No. 179,527 dated Oct. 2, 1917 entitled "Dusters" by Dunlap. The second above noted design is used primarily as a radiator duster and consequently is not a real substitute for the feather hand duster.

I have found that a particularly convenient hand duster can be produced by using a bunch of yarns consisting of crimped synthetic fibers in tow form retained at their intermediate region by a tightly encircling loop formed at the end of a twisted wire stem whose other end is affixed to a suitable handle. This results in a particularly durable, effective and attractive hand duster which is easily manufactured and which does not shed its hair or fibers when in use.

Consequently in accordance with this invention I provide a hand duster comprising a bunch of yarns consisting of crimped synthetic fibers, a twisted wire stem made of steel wire and defining at one end a single loop tightly encircling said bunch of yarns at the intermediate region of said yarns, and a handle secured to the free end of said stem.

In one embodiment, the yarns are crimped acrylic tow cut to about the same length of about 6 inches and bunched in sufficient number so that when encircled by said loop the diameter thereof will be of the order of ¾ of an inch. The wire is preferably mild steel wire of about 3/32 of an inch in diameter either galvanized or plastic coated.

The invention also provides a method of making a hand duster comprising the steps of bending a length of round wire of metal into the general shape of a hairpin having a rounded base and two similar legs extending therefrom, placing a bunch of yarns consisting of crimped synthetic fibers in tow state into the rounded base of the bent wire, the yarns extending parallel to one another in a direction which is perpendicular to the plane defined by the round region of the bent wire, with said plane passing through the middle point of the yarns, and urging the yarns toward the rounded base in a direction generally parallel to the legs and simultaneously winding the legs spirally around one another along a straight line while restraining the bent portion of the wire against rotation. In order to obtain a round fluffy head portion, the yarns are combed by means of spikes and then aligned together by means of a mandrel for trimming. In an alternative method the last two steps comprise trimming the yarns to the same length while extending in the direction of the stem but away therefrom, and then air blowing by means of a jet of air acting upon but tangentially of the mass of yarn while the stem is supported for rotation about its axis.

Preferably it will be necessary to cut the twisted wire handle or stem to a predetermined length before permanently securing the free end of the stem into a handle component suitably shaped for receiving the coiled end of the stem.

Examplary embodiments of this invention will now be described with reference to the accompanying drawings wherein:

FIG. 1, illustrates a piece of round metal wire bent into a hairpin configuration with a bunch of yarns placed in the bent portion of the wire.

FIG. 2, illustrates the combination of a bunch of yarns tightly gripped at their intermediate region by a loop defined by the middle portion of a metal wire whose legs are spirally wound along a straight line defining a stem.

FIG. 3, is a perspective view of a hand duster using a relatively long handle into which the stem of the coiled wire (not shown) extends, and FIGS. 4*a*, 4*b*, and 4*c*, are diagrammatic side views at a reduced scale of a hand duster head and trimming mandrel thereon.

Referring now to the figures of drawings, the combination seen in FIG. 1 comprises a bunch of yarns 10 consisting of crimped synthetic fibers in tow state adapted to be secured to the end of a structure for forming the head 12 of hand duster 60 shown in FIG. 3. In FIG. 1, a length of a wire 14 is shown, shaped in a hairpin configuration having a rounded base region 15 and two essentially parallel legs 17 and 18 extending from the rounded base 15 generally parallel to one another and in the same general direction. In FIG. 2 the assembly is shown with its legs 17 and 18 intertwisted thus forming stem 25 extending in a straight line from a loop 26 that tightly encircles the yarns 10 at their intermediate region. Wire 14 is made of round mild steel measuring about 3/32 of an inch in diameter.

The making of the assembly shown in FIG. 2 comprises the twisting of legs 17 and 18 about a longitudinal axis while retaining the yarns in the curved region 15 of the wire 14 and while this portion of the wire is prevented from turning. To this end the legs 17 and 18 extend through a hole 35 in plate 37 and a block 38 urges the bent portion 15 of wire 14 and the yarns 10 against the outer face 40 of plate 37. The surface of block 38 which contacts the bent portion 15 of wire 14 has a suitably shaped slot (not shown) in order to properly seat the curved end 15 of wire 14 as shown in dotted lines in FIG. 1. Legs 17 and 18 are suitably guided toward the jaws 42 of a rotation head 45. It will be seen that by rotating head 45 about axis 62 which extends essentially parallel to legs 17 and 18 and about centrally between the legs, and while restraining the bent portion 15 of wire 14 against rotation, legs 17 and 18 will first cross over one another as shown in FIG. 1 and then they will gradually wind into a spiral shape as shown in FIG. 2 at 25. However, this action also defines a loop at 26 which tightly grips the bunch of yarns 10 at their middle region and this gripping action virtually eliminates all possibilities of the yarns coming loose or disengaging from bunch 10.

The next step involves teasing of the fibers and trimming so as to obtain a relatively spherical fluffy head as at 12 in FIG. 3. Finally, the metal stem 25 is cut to a predetermined length and then its free end is permanently secured into an axial bore (not shown) in handle component 32.

For producing a satisfactory hand duster a sufficient amount of synthetic fibers must be used and best results have been obtained where the amount of fibers is such that upon winding of the wire the loop formed at the intermediate region thereof has an inside diameter of about ¾ of an inch. The starting bunch of yarns 10 is preferably six inches long.

The preferred synthetic fibers is crimped acrylic fibers in tow state such as used as a starting material in the weaving industry. This material has been found particularly advantageous in that it does not shed hair, it is relatively effective in a hand duster especially for household use, and it can be permanently teased into a large ball shape.

Teasing and trimming can be effected in two different ways namely combing or air-blowing. The results are slightly different in that a more fluffy but less resilient duster head is obtained with the combing method.

Combing may be effected successively and repeatedly by driving the bunch of yarns into a plurality of parallel elongated pointed spikes and pulling the bunch of yarns away from the spikes by exerting a sufficient force on the stem 25 in a direction which is essentially parallel to the longitudinal axis of the stem. This results in a large fluffy mass which however must be trimmed into a spherical shape by cutting the yarns to the same length. This can be achieved by bunching the ends of the fibers with the use of a cylindrical mandrel 50 (FIGS. 4*a*, 4*b* and 4*c*) which surrounds the yarns and which is pushed thereover from the stem 25 to a point located just beyond the loop 26 of wire 14. Thus, the yarns extend parallel to the stem 25 away therefrom and their ends project from the mandrel for easy trimming with any suitable means including a pair of scissors or a power driven trimmer. In FIG. 4*a* mandrel 50 is disposed coaxially around stem 25 behind the mass of teased yarns 51; in FIG. 4*b* mandrel 50 has been moved over the yarns to such an extent that practically only the ends 54 of the fibers project from mandrel 50. Trimming of ends 54 can then be effected to produce a rounded tail portion 64 as shown in FIG. 4*c*. Mandrel may then be removed and a slight agitation of the trimmed yarns will result in a spherical fluffy head as at 12 in FIG. 3.

In accordance with a different mode of teasing referred to above as "air-blowing", the bunch or yarns 10 as seen in FIG. 2 is preferably trimmed prior to teasing (although trimming could be carried out after teasing), and the step of trimming is essentially the same as that described above in connection with FIGS. 4*a* to 4*c* except that a mandrel 50 of lesser diameter should normally be used on account of the fact that flat crimped yarns take much less space than when teased. Air blowing is obtained by directing a jet of pressurized air toward the yarns in a direction which is generally perpendicular to the axis of stem 25 but spaced apart a distance less than the length of the yarns and moving the relative position of the jet of air and the bunch of yarns along the longitudinal axis of stem 25 in a reciprocating motion while the stem rotates around its axis at a speed which is sufficient to ensure that the yarns extend radially. A few minutes of air blowing should suffice to produce a round fluffy head portion as at 12 in FIG. 3.

We claim:

1. A hand duster for use primarily for dusting furniture, decorative articles and the like comprising a relatively large fluffy head of generally spherical configuration, a handle, and wire means retaining said head to one end of said handle, said head consisting of a very large number of fine, flexible elements extending essentially radially from a central region located in the center of said head, said elements being defined by a bundle of coextensively juxtaposed fibers which are retained together in their middle region by means of a single loop defined by said wire means at one end thereof and located in said central region, said wire means having two leg portions intertwisted along a common longitudinal axis thus defining a twisted wire stem, said stem projecting into an axial bore in said one end of said handle and being secured thereto, said bundle of fibers consisting of a bunch of crimped synthetic fibers in tow state measuring about six inches long and which form said generally spherical configuration, the structure of the fibers which provides said generally spherical configuration being a teased state resulting from teasing of the fibers of the bundle in tow state once secured to said wire means.

2. A hand duster as defined in claim 1, wherein said synthetic fibers are made of acrylic.

3. A hand duster as defined in claim 2, wherein said bunch of crimped acrylic fibers has been teased by combing and then trimming to said generally spherical configuration once secured to said wire means.

4. A hand duster as defined in claim 2, wherein said bunch of crimped acrylic fibers has been teased by tangential air blowing once secured to said wire means.

5. A hand duster as defined in claim 1, wherein the number of fibers in said bundle thereof is such that said loop when formed so as to tightly grip said fibers has a diameter of about ¾ of an inch and wherein said wire means is a round wire of mild steel whose outside diameter is of the order of 3/32 of an inch.

6. A hand duster for use primarily for dusting furniture, decorative articles and the like, comprising a relatively large fluffy generally spherical head portion, a handle, and a twisted wire retaining said head portion to said handle, said head portion being made of crimped acrylic fibers in tow state such as used as starting material in the textile industry, each fiber being about six inches long, said fibers being bunched together in the middle by said twisted wire, said twisted wire defining a loop at one end thereof which encircles said bunch of fibers in the middle, said twisted wire defining a twisted wire stem at the end opposite said loop, said stem being secured to the adjacent end portion of said handle, said bunched fibers being teased to provide said generally spherical head portion, and each fiber defining on either side of said loop a radially extending soft and flexible element.

* * * * *